US011393621B2

(12) United States Patent
Fukai et al.

(10) Patent No.: US 11,393,621 B2
(45) Date of Patent: Jul. 19, 2022

(54) WINDING WIRE, COIL, AND TRANSFORMER

(71) Applicants: FURUKAWA ELECTRIC CO., LTD., Tokyo (JP); FURUKAWA MAGNET WIRE CO., LTD., Tokyo (JP)

(72) Inventors: Hiroyuki Fukai, Tokyo (JP); Isamu Kobayashi, Tokyo (JP)

(73) Assignees: FURUKAWA ELECTRIC CO., LTD., Tokyo (JP); FURUKAWA MAGNET WIRE CO., LTD., Tokyo (JP)

( * ) Notice: Subject to any disclaimer, the term of this patent is extended or adjusted under 35 U.S.C. 154(b) by 774 days.

(21) Appl. No.: 16/165,112

(22) Filed: Oct. 19, 2018

(65) Prior Publication Data

US 2019/0051451 A1 Feb. 14, 2019

Related U.S. Application Data

(63) Continuation of application No. PCT/JP2017/015469, filed on Apr. 17, 2017.

(30) Foreign Application Priority Data

Apr. 22, 2016 (JP) ..... JP2016-086601

(51) Int. Cl.

| | |
|---|---|
| ***H01F 27/34*** | (2006.01) |
| ***H01B 7/00*** | (2006.01) |
| ***H01F 27/28*** | (2006.01) |
| ***H01F 30/10*** | (2006.01) |
| ***H01F 5/06*** | (2006.01) |
| ***H01F 5/00*** | (2006.01) |

(Continued)

(52) U.S. Cl.

CPC ..... *H01F 27/34* (2013.01); *H01B 7/00* (2013.01); *H01B 7/02* (2013.01); *H01B 7/30* (2013.01);

(Continued)

(58) Field of Classification Search

CPC ..... H01F 27/34; H01F 27/2823; H01B 7/00; H01B 7/0009; H01B 7/02; H01B 7/30; H01B 5/02; H01B 1/023; H01B 13/0036

(Continued)

(56) References Cited

U.S. PATENT DOCUMENTS 6,066,806 A * 5/2000 Higashiura ..... H01B 3/301 174/11 OR
2014/0272452 A1* 9/2014 Kamidaki ..... H01B 9/02 428/611

FOREIGN PATENT DOCUMENTS

JP 3036339 U * 4/1997
JP 2009-129654 A 6/2009

(Continued)

OTHER PUBLICATIONS

Chinese Office Action and Search Report for Chinese Application No. 201780023655.2 dated Jun. 30, 2020, with English translation of the Office Action.

(Continued)

*Primary Examiner* — Tszfung J Chan

(74) *Attorney, Agent, or Firm* — Birch, Stewart, Kolasch & Birch, LLP

(57) ABSTRACT

A winding wire having a stranded wire formed by twisting a plurality of element wires whose a copper wire having a wire diameter of 0.05 to 0.5 mm and an extrusion coating layer coating the plurality of the element wires, wherein at least one of the element wires has a magnetic layer on an outer circumference of the copper wire, and the thickness of the extrusion coating layer is 40 to 400 μm;

as well as a coil and a transformer using the winding wire.

7 Claims, 8 Drawing Sheets

(51) Int. Cl.
*H01B 7/02* (2006.01)
*H01B 7/30* (2006.01)

(52) U.S. Cl.
CPC ..... *H01F 5/00* (2013.01); *H01F 5/06* (2013.01); *H01F 27/28* (2013.01); *H01F 27/2823* (2013.01); *H01F 30/10* (2013.01)

(58) Field of Classification Search
USPC ..... 336/222; 174/106 R, 110 SR, 120 R, 174/120 SR, 126.1, 126.2
See application file for complete search history.

(56) References Cited

FOREIGN PATENT DOCUMENTS

| | | | |
|---|---|---|---|
| JP | 2009277396 | A * | 11/2009 |
| JP | 2009-283397 | A | 12/2009 |
| WO | WO 2010/086944 | A1 | 8/2010 |
| WO | WO 2016/027867 | A1 | 2/2016 |

OTHER PUBLICATIONS

International Search Report (PCT/ISA/210) issued in PCT/JP2017/015469, dated Jun. 13, 2017.
Japanese Office Action issued in application No. 2016-086601, dated Jul. 13, 2018.
Written Opinion of the International Searching Authority (PCT/ISA/237) issued in PCT/JP2017/015469, dated Jun. 13, 2017.
Extended European Search Report for European Application No. 17785948.5, dated Nov. 29, 2019.
Office Action issued in corresponding Chinese Application No. 201780023655.2, dated Nov. 3, 2021, with English translation.
Chinese Office Action for corresponding Chinese Application No. 201780023655.2, dated Apr. 25, 2021, with an English translation.

* cited by examiner

WINDING WIRE, COIL, AND TRANSFORMER

CROSS-REFERENCE TO RELATED APPLICATIONS

This application is a Continuation of PCT International Application No, PCT/JP2017/015469 filed on Apr. 17, 2017, which claims priority under 35 U.S.C. § 119 (a) to Japanese Patent Application No. 2016-086601 filed in Japan on Apr. 22, 2016. Each of the above applications is hereby expressly incorporated by reference, in its entirety, into the present application.

TECHNICAL FIELD

The present invention relates to a winding wire, a coil, and a transformer.

BACKGROUND ART

In electrical or electronic equipment, usually, a switching power supply including a switching element and a transformer (also called potential transformer) is generally used. In Japan, the mains electricity is 50 Hz/60 Hz. In a case in which voltage transformation, current transformation, or the like is to be achieved without changing the frequency of such a low frequency power supply, it is necessary to employ a large-sized power supply in order to obtain the necessary output power. Thus, switching power supplies that have been reduced in size to practically usable sizes, by increasing the frequency of the mains electricity to high frequency such as several ten kHz, or higher by using a switching element before voltage transformation at the transformer, and increasing the amount of power transmitted per second, are generally used.

A transformer that is mounted in a switching power supply is such that when an alternating current voltage of high frequency is transformed, the coil loss increases. Therefore, an investigation has been conducted on a transformer that is capable of suppressing this loss. For example, a transformer including coils obtained by winding the stranded wire formed by twisting a plurality of element wires, may be mentioned. An example of such a coil may be the litz wire coil described in Patent Literature 1.

CITATION LIST

Patent Literatures

Patent Literature1: JP-A-2009-283397 ("JP-A" means unexamined published Japanese patent application)

SUMMARY OF INVENTION

Technical Problem

However, in recent years, there has been a demand for size reduction of the switching power supplies, and in order to meet this demand, further increase of frequency is in progress. Therefore, those winding wires used in high frequency transformers are required to have the performance of exhibiting a small alternating current resistance during the passage of a high-frequency current when the winding wire is produced into a coil, and further reducing the coil loss or the transformer loss.

In order to reduce losses in the coil described above, it is effective to decrease the element wire diameter and to increase the number of element wires. When the element wire diameter is decreased, a skin effect is suppressed during the passage of electric current, and the number of the element wires to be twisted can be increased. However, there are limitations on the diameter reduction of element wires. Furthermore, in regard to a wire diameter at which a proximity effect becomes dominant rather than the skin effect in connection with the alternating current resistance, even if the wire diameter is made smaller, the alternating current resistance cannot be sufficiently reduced.

The present invention is contemplated for providing a winding wire having a small alternating current resistance during the passage of a high-frequency current and capable of effectively suppressing the coil loss or the transformer loss, and to provide a coil and a transformer, which use this winding wire.

Solution to Problem

The inventors of the present invention found that when a high-frequency current is passed through a stranded wire, which is produced by coating a stranded wire formed using an element wire that has a magnetic layer having a particular thickness on the outer circumference of a copper wire having a particular wire diameter, with a resin layer having a thickness of 40 to 400 μm, the alternating current resistance is sufficiently small, and that when this coated stranded wire is used as a winding wire for a coil, the coil loss or the transformer loss can be effectively suppressed. The present inventors have further continued research based on this finding, and have completed the present invention.

That is, the above-described problems of the present invention can be solved by the following means.

<1> A winding wire having a stranded wire formed by twisting a plurality of element wires, the element wire having a copper wire having a wire diameter of 0.05 to 0.5 mm; and an extrusion coating layer coating the plurality of the element wires, wherein at least one of the element wires has a magnetic layer on an outer circumference of the copper wire, and the thickness of the extrusion coating layer is 40 to 400 μm.

<2> The winding wire described in the above item <1>, comprising a baked coating layer on an outer circumference of the magnetic layer.

<3> The winding wire described in the above item <1> or <2>, wherein the extrusion coating layer includes a winding wire extrusion coating layer disposed on an outer surface of the stranded wire.

<4> The winding wire described in any one of the above items <1> to <3>, wherein the extrusion coating layer is composed of three or more layers.

<5> A coil, using the winding wire described in any one of the above items <1> to <4>.

<6> A transformer, comprising the coil described in the above item <5>.

<7> The transformer described in the above item <6>, wherein the transformer is used for a high frequency switching power supply operating at a frequency of 100 kHz to 1 MHz.

In the description of the present invention, any numerical expressions in a style of using " . . . to . . . " will be used to indicate a range including the lower and upper limits represented by the numerals given before and after "to", respectively.

Effects of Invention

The present invention can provide a winding wire having a small alternating current resistance during the passage of a high-frequency current and capable of effectively suppressing the coil loss or the transformer loss when this winding wire is used in a coil or a transformer, and a coil and a transformer, which use this winding wire.

Other and further features and advantages of the invention will appear more fully from the following description, appropriately referring to the accompanying drawings.

MODE FOR CARRYING OUT THE INVENTION

«Winding Wire»

Figure 1:
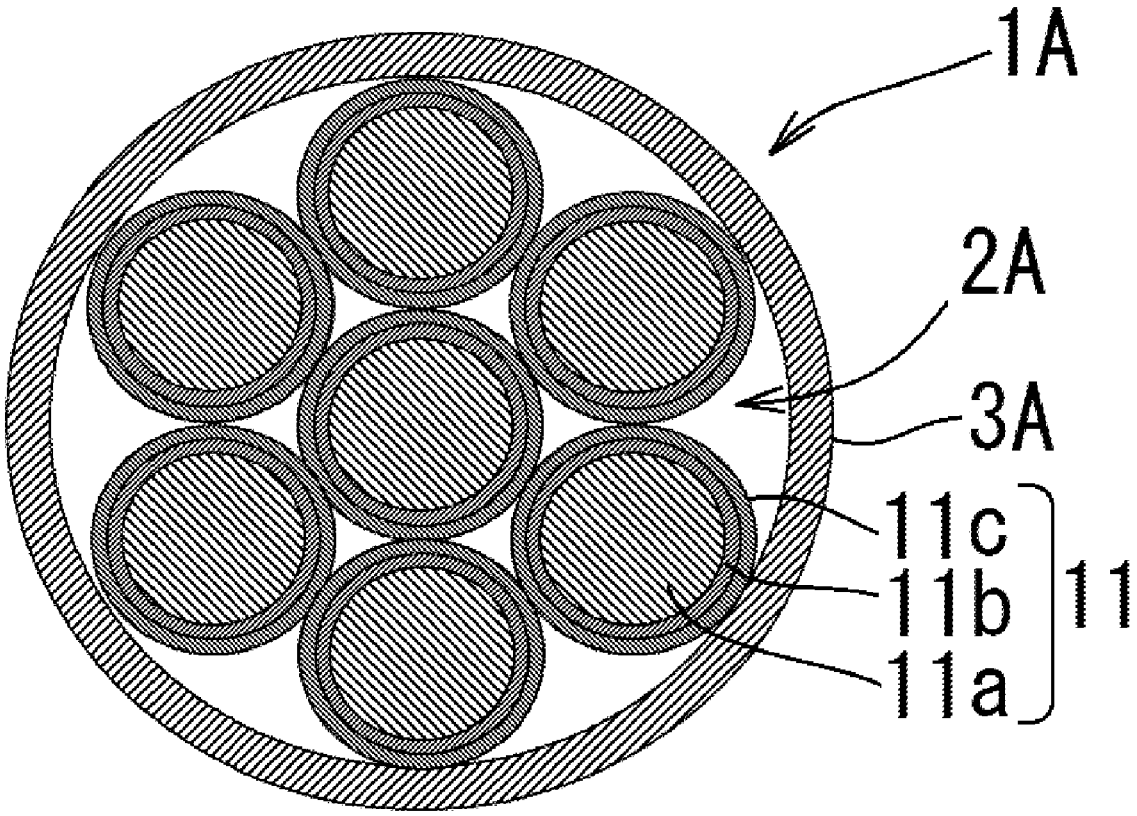
FIG. 1 is a schematic end view illustrating a preferred example of the winding wire of the present invention.

The winding wire of the present invention is preferably used as a winding wire for a coil or a transformer and has a stranded wire obtained by twisting a plurality of element wires, whose copper wire has a wire diameter of 0.05 to 0.5 mm; and an extrusion coating layer covering the plurality of the element wires.

In regard to the winding wire of the present invention, at least one element wire among the element wires included in the stranded wire is a magnetic element wire having a magnetic layer on the outer circumference of the copper wire. Furthermore, the thickness of the extrusion coating layer is 40 to 400 μm.

The winding wire of the present invention having the above-described configuration can effectively suppress the alternating current resistance during the passage of a high frequency current.

According to the present invention, the extrusion coating layer is such that the coating embodiment of the element wire and the like are not particularly limited as long as the extrusion coating layer can coat a plurality of element wires. It is preferable that this extrusion coating layer is formed by extrusion molding in order to have the thickness that will be described below. However, according to the present invention, this coating layer is referred to as extrusion coating layer for convenience, in order to distinguish the coating layer from the baked coating layer that will be described below. However, it is acceptable as long as the extrusion coating layer can be distinguished from the baked coating layer provided on the copper wire side (inner side), and the extrusion coating layer may also be referred to as outer coating layer or outer resin layer. Similarly, the baked coating layer may also be referred to as inner coating layer or inner resin layer. Therefore, according to the present invention, the extrusion coating layer and the baked coating layer are not limited to layers formed by extrusion molding and baking, respectively, without being restricted by the names, and upon determining the gist or technical scope of the present invention, the terms "extrusion" and "baked" are not to be considered as matters specifying the present invention that lead to a restrictive interpretation of the present invention.

Examples of the embodiment of coating a plurality of element wires with the extrusion coating layer include an embodiment in which the extrusion coating layer is provided on the outer surface of the stranded wire and (integrally) covers a plurality of element wires (the extrusion coating layer of this embodiment is referred to as winding wire extrusion coating layer); an embodiment in which the extrusion coating layer is provided as the outermost layer of each element wire and thereby (individually) covers multiple element wires (the extrusion coating layer of this embodiment is referred to as element wire extrusion coating layer); and an embodiment of using these in combination. For all of these embodiments, the alternating current resistance based on the proximity effect can be effectively reduced, as will be described below, by providing a winding wire having the above-described configuration with an extrusion coating layer having the above-described thickness.

According to the present invention, it is preferable that the extrusion coating layer includes a winding wire extrusion coating layer.

According to the present invention, the thickness of the extrusion coating layer is defined as the total thickness of the winding wire extrusion coating layer described above and the element wire extrusion coating layer of the element wire disposed in the outermost row of the stranded wire.

The thickness of the element wire extrusion coating layer or the winding wire extrusion coating layer usually refers to the difference between the inner diameter and the outer diameter of each extrusion coating layer. More particularly, the thickness of the winding wire extrusion coating layer refers to the difference ($r_T$–$r_L$) between the radius $r_L$ of a virtual circumscribed circle circumscribing a plurality of element wires disposed in the outermost row of the stranded wire and the radius $r_T$ of the outer contour line of the winding wire extrusion coating layer, in a cross-section perpendicular to the axial line of the winding wire. In a case in which the outer contour line of the winding wire extrusion coating layer is not a circle, the radius $r_T$ of the winding wire extrusion coating layer is defined as the radius of a virtual circumscribed circle circumscribing the outer contour line of the winding wire extrusion coating layer in the above-described cross-section.

Here, the element wires disposed in the outermost row of the stranded wire mentioned above refers to the element wires disposed in the outermost row among the element wires that are disposed adjacently to one another in the radial direction of the stranded wire.

According to the present invention, all of the various layers such as the extrusion coating layer (element wire extrusion coating layer or winding wire extrusion coating layer) may be respectively a single layer or may be a multilayer of two or more layers.

According to the present invention, the number of layers of each layer is determined by observing a cross-section of the layer, irrespective of whether the types and contents of the resins and additives forming the layer are different or identical. Specifically, when a cross-section of a certain layer is observed at a magnification ratio of 200 times, in a case in which annual ring-like boundaries cannot be recognized, the total number of the certain layer is considered as 1, and in a case in which annual ring-like boundaries can be recognized, the number of layers of the certain layer is designated as (number of boundaries+1).

In the following description, the structure of the winding wire of the present invention and the stranded wire, element wire, and extrusion coating layer that form the winding wire of the present invention will be described with reference to the attached drawings; however, the present invention is not intended to be limited to this description.

Meanwhile, in the respective diagrams, the contour shape of the winding wire extrusion coating layer is illustrated as an annular ring shape; however, in regard to the winding wire of the present invention, the shape of the outer contour line of the winding wire extrusion coating layer is not limited to an annular ring shape, and the gap between the winding wire extrusion coating layer and the stranded wire may be filled. In this case, the contour shape is not limited to a circular shape and may be, for example, an elliptical shape, a straight knurl shape (a gear shape or a wavy shape), or the like.

<Structure of Winding Wire>

In regard to the winding wire of the present invention, the structure is not particularly limited as long as the winding wire has a stranded wire and an extrusion coating layer. First, the structure of the winding wire will be described, and the details of the stranded wire and the like will be described later.

Winding wires 1A to 1E illustrated in FIG. 1 to FIG. 5 are all in the embodiment of having only a winding wire extrusion coating layer as the extrusion coating layer.

Preferred winding wire 1A of the present invention has, as illustrated in FIG. 1, a stranded wire 2A formed by twisting seven magnetic baked coated element wires 11; and an extrusion coating layer 3A coating the outer circumference of the stranded wire 2A.

Figure 2:
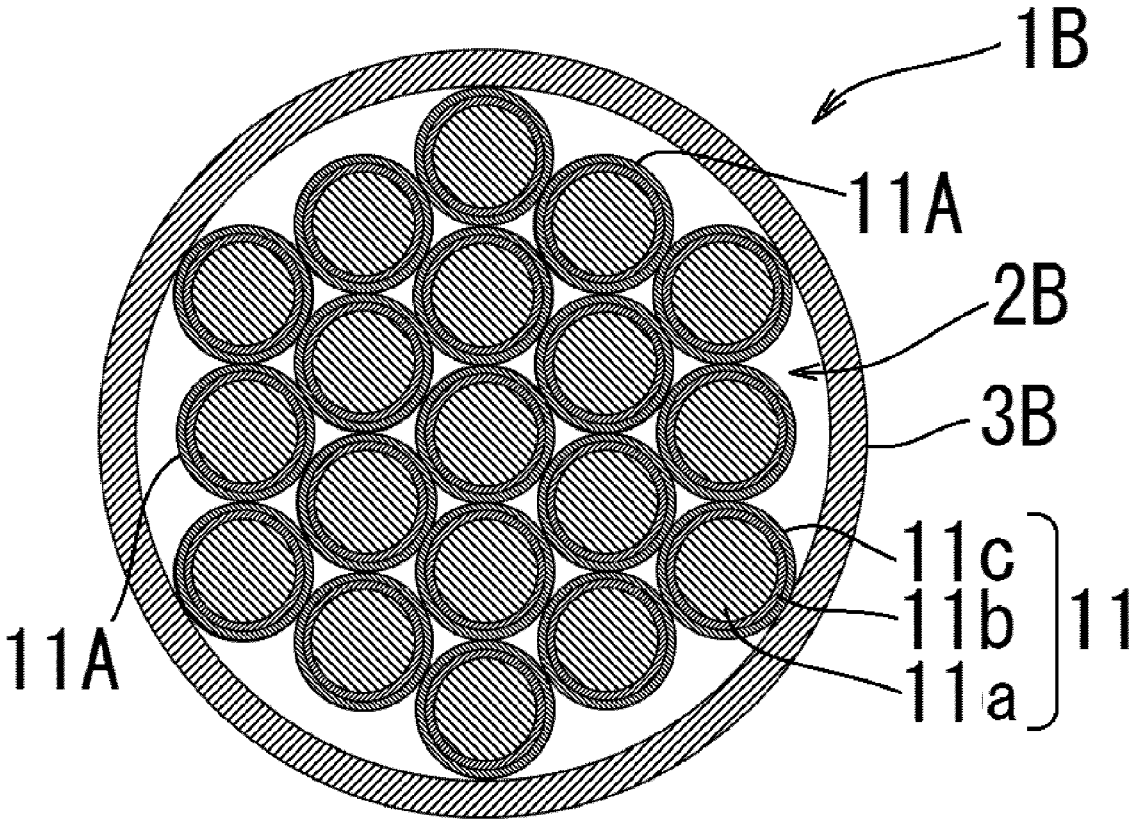
FIG. 2 is a schematic end view illustrating a preferred example of the winding wire of the present invention.

Preferred winding wire 1B of the present invention has, as illustrated in FIG. 2, a stranded wire 2B formed by twisting nineteen magnetic baked coated element wires 11; and an extrusion coating layer 3B coating the outer circumference of the stranded wire 2B.

Figure 3:
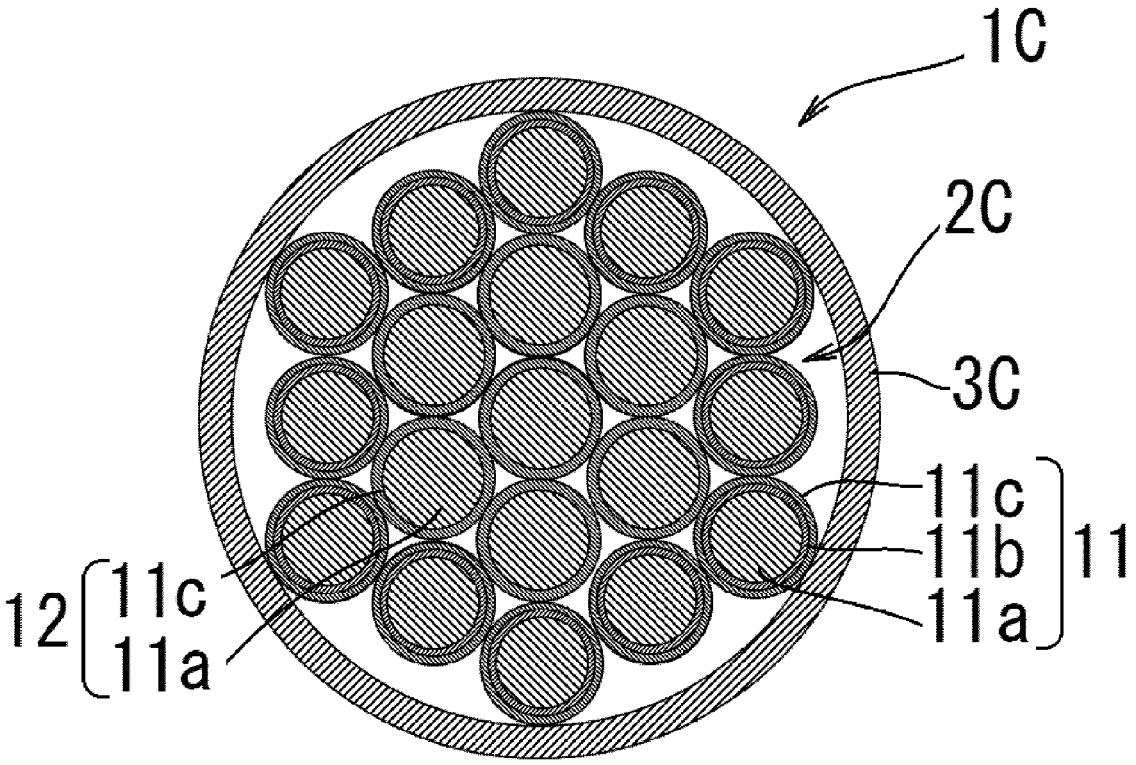
FIG. 3 is a schematic end view illustrating a preferred example of the winding wire of the present invention.

Preferred winding wire 1C of the present invention has, as illustrated in FIG. 3, a stranded wire 2C formed by twisting twelve magnetic baked coated element wires 11 and seven baked coated element wires 12; and an extrusion coating layer 3C coating the outer circumference of the stranded wire 2C.

In the stranded wire 2C, the magnetic baked coated element wires 11 are arranged on the outer circumference of baked coated element wires 12. As such, when the stranded wire is formed from magnetic baked coated element wires 11 and baked coated element wires 12, a balance can be achieved between a decrease in the alternating current resistance and the cost, and a winding wire that can coped with the use application or required performance can be obtained. Furthermore, when the magnetic baked coated element wires 11 are disposed on the outer circumference, a magnetic flux generated by other adjacent winding wires can be prevented from penetrating into the subject winding wire, an increase in the alternating current resistance caused by the proximity effect can be suppressed, as compared to a winding wire having the same number (in the case of winding wire 1C, 19) of magnetic baked coated element wires 11.

Figure 4:
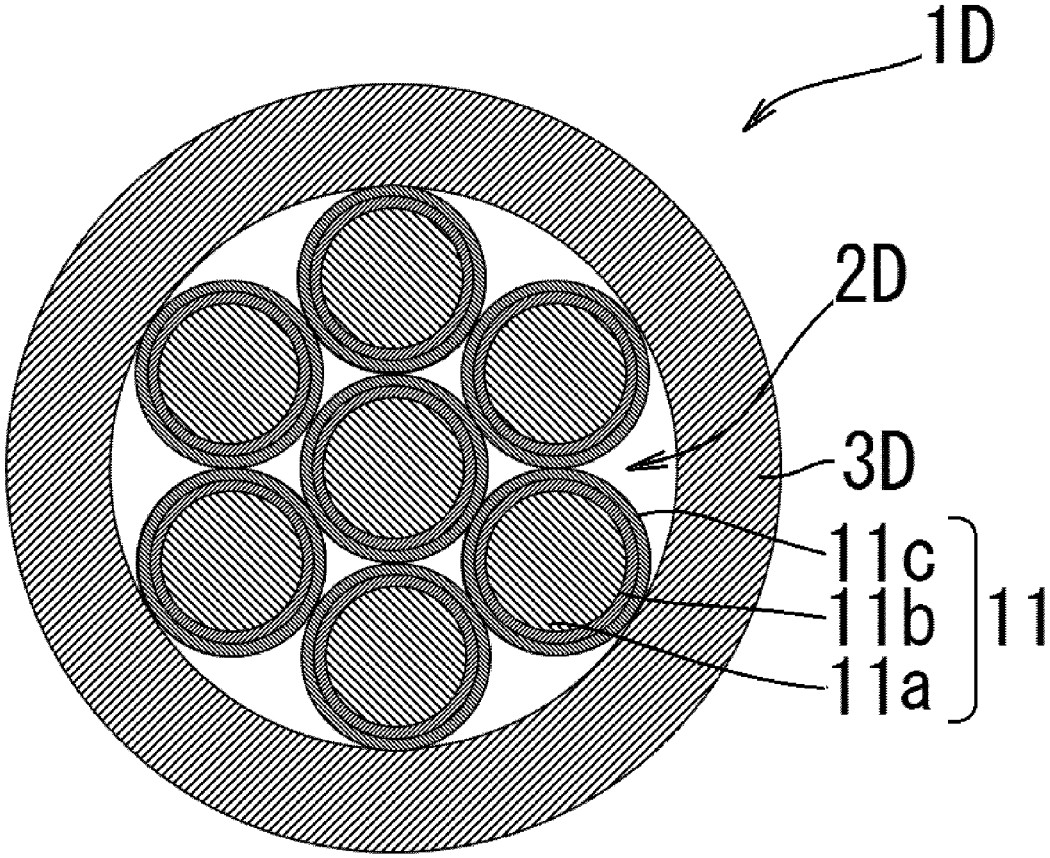
FIG. 4 is a schematic end view illustrating a preferred example of the winding wire of the present invention.

Preferred winding wire 1D of the present invention is similar to the winding wire 1A, except that the thickness of the extrusion coating layer 3D is different as illustrated in FIG. 4. When the thickness of the extrusion coating layer is made thick to a predetermined extent, a sufficient distance between winding wires can be secured, and an alternating current resistance caused by the proximity effect can be effectively reduced.

Figure 5:
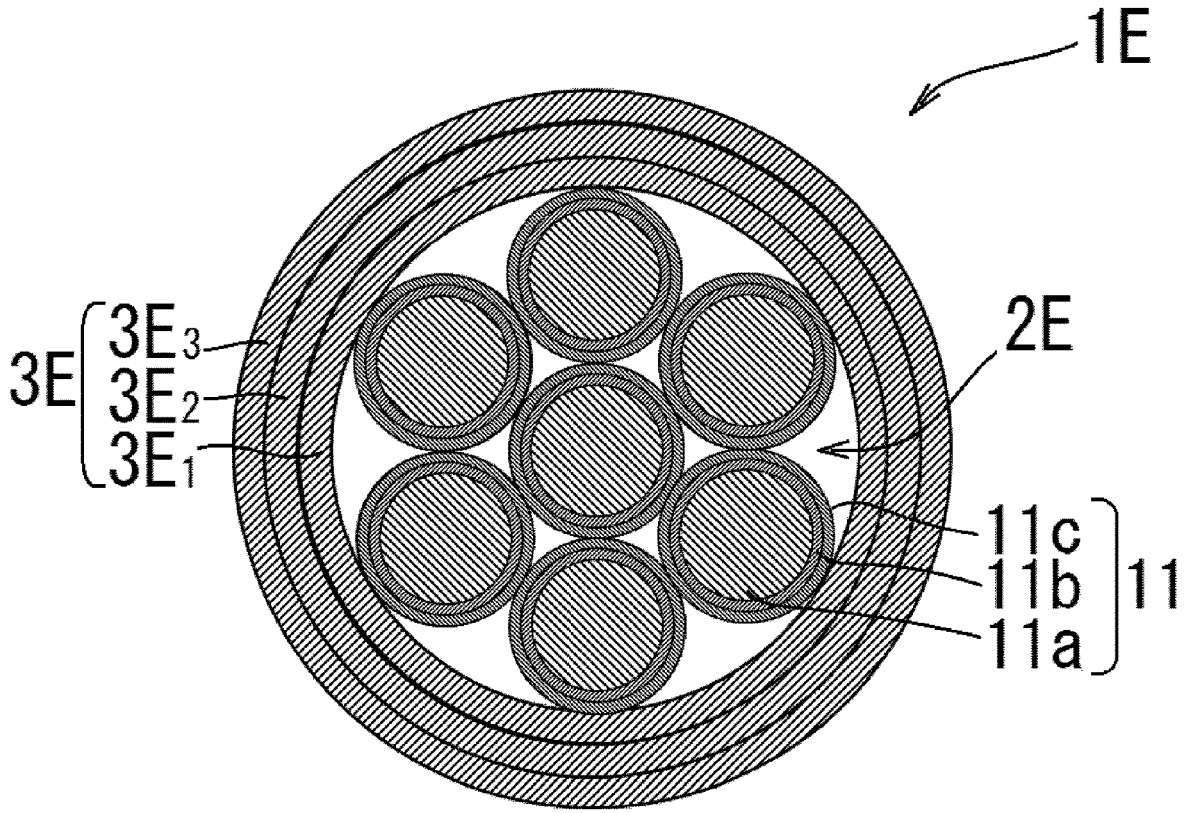
FIG. 5 is a schematic end view illustrating a preferred example of the winding wire of the present invention.

Preferred winding wire 1E of the present invention is similar to the winding wire 1D, except that the extrusion coating layer 3E has a three-layer structure composed of winding wire extrusion coating layers $\mathbf{3}E_1$, $\mathbf{3}E_2$, and $\mathbf{3}E_3$ in order from the inner side (stranded wire 2E), as illustrated in FIG. 5. In the winding wire 1E, the respective layers forming the three-layer structure are all set to have the same thickness; however, in the present invention, the relation concerning the thicknesses of various layers is not particularly limited.

Figure 6:
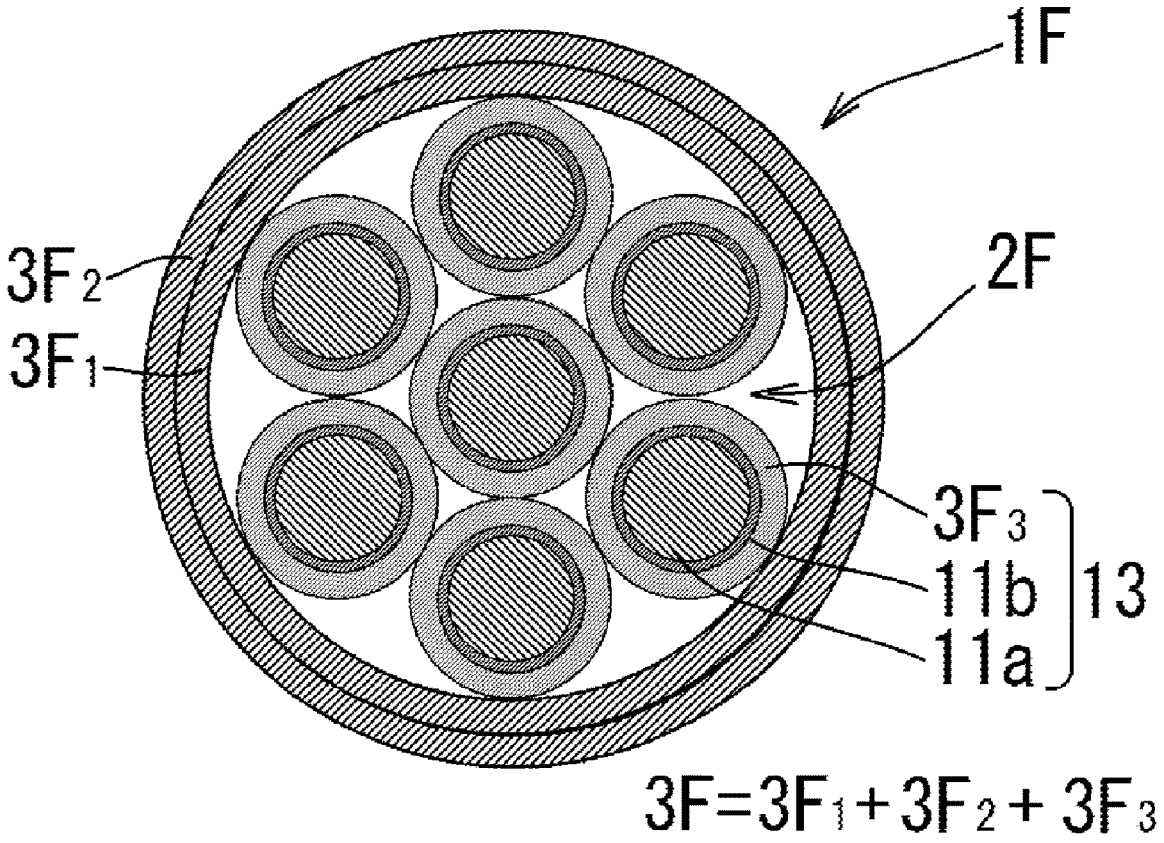
FIG. 6 is a schematic end view illustrating a preferred example of the winding wire of the present invention.

Winding wire 1F is in an embodiment such that the extrusion coating layer 3F has both winding wire extrusion coating layers $\mathbf{3}F_1$ and $\mathbf{3}F_2$ and an element wire baked coating layer $\mathbf{3}F_3$, as illustrated in FIG. 6. This winding wire 1F has a stranded wire 2F formed by twisting seven magnetic extrusion coated element wires 13, each magnetic extrusion coated element wire having an element wire extrusion coating layer $\mathbf{3}F_3$ as the outermost layer of a magnetic element wire; and a winding wire extrusion coating layer covering the outer circumference of the stranded wire 2F. This winding wire extrusion coating layer has a two-layer structure composed of winding wire extrusion coating layers $\mathbf{3}F_1$ and $\mathbf{3}F_2$ in order from the inner side (stranded wire 2F).

According to the present invention, the element wires used in the winding wires 1A to 1F described above are not limited to the winding wires illustrated in the various diagrams, and each winding wire may be changed to another element wire that is not illustrated in the diagram.

Furthermore, regarding the structure of the winding wire of the present invention, a structure appropriately combining the various structures of the winding wires 1A to 1F can also be adopted.

<Stranded Wire>

The stranded wire used for the present invention is not particularly limited as long as the stranded wire is formed by twisting a plurality of element wires that include at least one element wire having a magnetic layer on the outer circumference of a copper wire.

Regarding the number of element wires used when the element wires are twisted, for example, two or more element wires can be used. When the alignment property of the element wires is considered, the number of element wires is preferably seven or more, with six element wires disposed around one element wire, and when the alternating current resistance and practical processability are considered, the number of element wires is preferably 100 or less. Particularly, when the alignment property is considered, the number of element wires is more preferably 7 to 37.

Regarding the element wire having a magnetic layer on the outer circumference of a copper wire, the element wire being included in the stranded wire, it is preferable that element wires having a magnetic layer are disposed in the outermost row in the disposition of the element wires that form the stranded wire, from the viewpoint that penetration of an interlinkage magnetic flux from the outside can be effectively prevented. Alternatively, it is preferable that an element wire having a magnetic layer on the outer circumference of a copper wire and another element wire are alternately disposed, from the viewpoint that the proximity effect between the element wires can be effectively prevented. Here, the element wires disposed in the outermost row are not limited to the element wires disposed adjacently to each other in the radial direction of the stranded wire with respect to the thickness of the extrusion coating layer, and also refer to the element wires disposed on the outermost side of the stranded wire. For example, the magnetic baked coated element wire 11A in FIG. 2 is not an element wire disposed in the outermost row with respect to the thickness of the extrusion coating layer; however, the magnetic baked coated element wire 11A becomes an element wire disposed in the outermost row with respect to the disposition of the element wires described above.

The number of element wires having a magnetic layer on the outer circumference of the copper wire, the element wires being included in the stranded wire, is not particularly limited as long as there are one or more such element wires. In a case in which the element wires having a magnetic layer are disposed in the outermost row, the proportion of the element wires having a magnetic layer is preferably 40% or higher with respect to the number of element wires, when twisting of 37 wires is considered (18 element wires disposed in the outermost row). Furthermore, when twisting of seven wires (six element wires disposed in the outermost row) is considered, the proportion is preferably 85% or higher. Meanwhile, the upper limit is preferably 100% or lower with respect to the number of element wires described above.

The element wire having a magnetic layer on the outer circumference of a copper wire includes a magnetic element wire, a magnetic baked coated element wire, and element wires having an element wire extrusion coating layer on the outer circumference of these magnetic element wires, all of which will be described below.

The disposition of element wires, the direction of twisting, the pitch of twisting, and the like used at the time of twisting the element wires can be set as appropriate according to the use or the like.

Examples of such a stranded wire include the stranded wires 2A to 2F illustrated in FIG. 1 to FIG. 6.

—Element Wire—

Examples of the element wire that forms a stranded wire include a copper wire, a magnetic element wire, a baked coated element wire, and a magnetic baked coated element wire. Furthermore, element wires having respectively an element wire extrusion coating layer on the outer circumference of the above-described element wires and the like may also be used.

1. Copper Wire (Bare Wire)

Regarding the copper wire, those copper wires that have been conventionally used as winding wires for coils or the like can be used.

Preferably, a copper wire, or a copper wire formed from low-oxygen copper having an oxygen content of 30 ppm or less (more preferably 20 ppm or less) or crude copper may be used.

The cross-sectional shape of the copper wire may be a circular shape or a rectangular shape (straight-angled shape); however, from the viewpoint of the twistability, a circular shape is preferred.

An outer diameter φ of a copper wire (a wire diameter) is 0.05 to 0.5 mm. At this wire diameter, generally, the proximity effect becomes dominant to the skin effect. However, according to the present invention, since the alternating current resistance at the time of passing a high frequency current can be sufficiently suppressed, a copper wire having the above-described wire diameter can be used. The wire diameter is not particularly limited as long as it is in the range described above; however, for example, the wire diameter is more preferably 0.1 to 0.4 mm.

2. Magnetic Element Wire

A magnetic element wire is an element wire having a magnetic layer on the outer circumference of the copper wire described above.

This magnetic layer is a layer formed from a magnetic material and is provided on the outer circumferential surface of a copper wire. By using an element wire having a magnetic layer, the coil loss or the transformer loss can be further suppressed.

The magnetic material may be any substance exhibiting ferromagnetism, and examples include nickel, a Ni alloy (for example, a Ni—Fe alloy), iron, an iron alloy (electromagnetic soft iron, silicon steel, or the like), a permalloy, and a ferrite compound (Mn—Zn ferrite or the like). The magnetic material is preferably a material adequate for electroplating, and for example, nickel, a Ni alloy, iron, or an iron alloy is more preferred.

The thickness of the magnetic layer is not particularly limited; however, from the viewpoint of the alternating current resistance, for example, the thickness of the magnetic layer is preferably 1% to 10% of the outer diameter of the copper wire.

The magnetic layer can be formed by, for example, electroplating. There are no particular limitations on the plating liquid and the plating conditions.

In regard to the winding wire of the present invention, for which the wire diameter of the copper wire and the thickness of the extrusion coating layer are set to particular ranges, when the stranded wire includes a magnetic element wire, the penetration of magnetic flux into another copper wire or winding wire existing in the vicinity when the stranded wire is produced into a coil can be suppressed. Therefore, the generation of an eddy current can be suppressed. As a result, it is considered that the winding wire of the present invention can suppress an increase in the direct current resistance and an increase in the alternating current resistance caused by the skin effect and the proximity effect in a well-balanced manner, and a reduction of the alternating current is enabled.

3. Baked Coated Element Wire

The baked coated element wire is an element wire having a baked coating layer on the outer circumference of the copper wire described above.

This baked coating layer is a layer containing, preferably, a thermosetting resin as a resin component (also called enamel layer) and is provide on the surface of the outer circumference of the copper wire.

The thermosetting resin can be used without any particular limitations, as long as the resin is a thermosetting resin that is usually used as an electric wire or a winding wire. Specific example thereof may include polyamideimide (PAI), polyimide (PI), polyetherimide (PEI), polyesterimide (PEsI), polyurethane (PU), polyester (PEst), polybenzoimidazole, a melamine resin, an epoxy resin, or the like. Amang these, polyamideimide, polyimide, polyetherimide, polyesterimide, polyurethane, or polyester is preferred. The baked coating layer may contain one kind or two or more kinds of thermosetting resins.

The baked coating layer may contain various additives that are usually used in an electric wire or a winding wire. In this case, the content of the additives is not particularly limited; however, the content is preferably 5 parts by mass or less, and more preferably 3 parts by mass or less, with respect to 100 parts by mass of the resin component.

The thickness of the baked coating layer is not particularly limited; however, from the viewpoint of attaining both securement of insulation properties between element wires and the space factor of the conductor (copper wire), the thickness is preferably, for example, 10 to 15 μm.

The baked coating layer can be formed by a known method. For example, a method of applying a varnish of a resin component such as a thermosetting resin on the outer circumference of a copper wire or the like and baking the varnish, is preferred. This varnish includes a resin component and a solvent, and if necessary, also includes a curing agent for the resin component or various additives. The solvent is preferably an organic solvent, and any solvent capable of dissolving or dispersing the resin component is selected as appropriate.

Regarding the method for applying a varnish, a conventional method can be selected, and for example, a method of using a die for varnish application having an opening that has a shape similar or approximately similar to the cross-sectional shape of the copper wire, may be employed. Baking of the varnish is usually carried out in a baking furnace. The conditions employed at baking vary depending on the type of the resin component or the solvent, and the like and cannot be determined uniformly; however, for example, conditions including a furnace temperature of 400° C. to 650° C. and a passing time period of 10 to 90 seconds may be mentioned.

4. Magnetic Baked Coated Element Wire

The magnetic baked coated element wire is a magnetic element wire having a baked coating layer, and the magnetic baked coated element wire has a magnetic layer on the outer circumference of the copper wire described above and further has a baked coating layer on the outer circumference of this magnetic layer.

The copper wire, magnetic layer, and baked coating layer in the magnetic baked coated element wire are respectively as described above.

5. Element Wire has an Element Wire Extrusion Coating Layer on the Outer Circumference Thereof This element wire has an element wire extrusion coating layer as an outermost layer on the above-described element wire such as a copper wire, a magnetic element wire, a baked coated element wire, or a magnetic baked coated element wire.

The copper wire, magnetic layer, and baked coating layer in this element wire are respectively as described above.

The element wire extrusion coating layer may be a layer containing, preferably, a thermoplastic resin as will be described below as a resin component. By providing an element wire extrusion coating layer as an outermost layer of an element wire, an alternating current resistance caused by the proximity effect can be suppressed, similarly to the extrusion coating layer that will be described below.

The thickness of the element wire extrusion coating layer carried by the element wire is not particularly limited as long as the thickness satisfies the requirement for the thickness of the extrusion coating layer that will be described below. However, in a case in which the element wire having an element wire extrusion coating layer further has a winding wire extrusion coating layer, for example, the thickness is preferably 15 to 30 μm.

Regarding the element wire extrusion coating layer, a method of forming the element wire extrusion coating layer by extrusion molding (extrusion coating) the resin composition that will be described below, on the outer circumference of a copper element or the like is preferred.

<Extrusion Coating Layer>

Regarding the extrusion coating layer, the structure, position of formation, and the like of the coating layer are not particularly limited as long as the extrusion coating layer can cover a plurality of element wires. The position of formation is as described with regard to the embodiment of coating described above.

The thickness of the extrusion-coating layer is 40 to 400 μm. In the winding wire of the present invention whose the wire diameter of the copper wire is set and that uses a magnetic element wire, when the thickness of the extrusion coating layer is in the range described above, as will be shown in the Examples, a balance is achieved between the direct current resistance and the resistance caused by the skin effect and the proximity effect, and consequently, the alternating current resistance can be effectively suppressed. However, in regard to the winding wire, when the thickness of the extrusion coating layer is less than 40 μm, the space factor can be made large while the increase in resistance caused by the skin effect is suppressed, and therefore, the direct current resistance can be suppressed. However, since the distance between winding wires cannot be sufficiently secured when the winding wire is wound into a coil, the alternating current resistance caused by the proximity effect cannot be sufficiently suppressed. On the other hand, when the distance is more than 400 μm, an increase in resistance caused by the skin effect and the proximity effect can be suppressed; however, in order to wind the wire around a core such as a bobbin having the same size, the finishing outer diameter of the stranded wire should be made identical, and therefore, the wire diameter of the copper wire must be made small. Accordingly, the influence exerted by an increase in the direct current resistance increases, and thus the alternating current resistance increases.

Furthermore, in regard to the winding wire of the present invention, since the thickness of the extrusion coating layer is 40 to 400 μm, in addition to the effect described above, the winding wire has favorable bending processability, can be wound around a small-sized core, and can sufficiently cope with the requirement of size reduction or weight reduction of the switching power supply or the coil. Moreover, since a sufficient creepage distance between the winding wires on the occasion of being produced into a coil can be secured, an insulating tape between a primary coil and a secondary coil in a transformer and an insulating tape between the coils and the core can be omitted. Thus, it is more effective for the size reduction of a transformer.

The thickness of the extrusion coating layer is preferably 40 to 200 μm, and more preferably 60 to 100 μm, from the viewpoints of reducing the alternating current resistance and size reduction or weight reduction.

The extrusion coating layer can be produced into a laminated structure having two or more layers as described above; however, above all, the winding wire extrusion coating layer can be produced into a laminated structure having preferably three or more layers, and more preferably three to five layers. When the extrusion coating layer is produced into a laminated structure having three or more layers, a sufficient creepage distance of the winding wire can be secured. Therefore, in the transformer of the present invention, an insulating tape that is usually used in order to secure insulation properties can be omitted.

In a case in which the extrusion coating layer has a laminated structure, the thicknesses of each of the layers are not particularly limited as long as the total thickness of each of the layers is in the range described above. For example, in a case in which the extrusion coating layer has an inner layer, an intermediate layer, and an outer layer, the thickness of each of the layers is preferably 13 to 130 μm.

The extrusion coating layer preferably contains a thermoplastic resin as a resin component. The thermoplastic resin can be used without any particular limitations, as long as the resin is a thermoplastic resin that is usually used as an electric wire or a winding wire. Specific example thereof may include commodity engineering plastics, such as polyamide (nylon), polyacetal (POM), polycarbonate (PC), polyphenylene ether (PPE, including a modified polyphenylene ether), polybutylene terephthalate (PBT), polyethylene terephthalate (PET), polyethylene naphthalate (PEN), and ultra-high-molecular-weight polyethylene; and in addition, super-engineering plastics, such as polysulfone (PSF), polyether sulfone (PES), polyphenylene sulfide (PPS), polyarylate (PAR), polyetherketone (PEK), polyaryletherketone (PAEK), tetrafluoroethylene/ethylene copolymer (ETFE), polyetheretherketone (PEEK, including a modified polyetheretherketone), polyetherketoneketone (PEKK), tetrafluoroethylene/perfluoroalkylvinylether copolymer (PFA), polytetrafluoroethylene (PTFE), a thermoplastic polyimide resin (TPI), a thermoplastic polyamideimide (TPAI), and a liquid crystalline polyeste; and further polymer alloys containing the foregoing engineering plastics, such as a polymer alloy composed of polyethylene terephthalate or polyethylene naphthalate as a base resin, ABS/polycarbonate, NYLON 6,6, aromatic polyamide resin, polyphenylene ether/NYLON 6,6, polyphenylene ether/polystyrene, and polybutylene terephthalate/polycarbonate. The extrusion coating layer may contain one kind or two or more kinds of thermoplastic resins.

In a case in which the extrusion coating layer has a laminated structure, the resin components that are incorporated into the respective layers at the maximum contents may be identical with or different from each other.

The extrusion coating layer may contain various additives that are usually used in an electric wire or a winding wire. In this case, the content of the additives is not particularly limited; however, the content is preferably 5 parts by mass or less, and more preferably 3 parts by mass or less, with respect to 100 parts by mass of the resin component.

The extrusion coating layer can be formed by extrusion molding (extrusion coating) a resin composition on the outer circumference of a stranded wire so as to have the thickness described above. The resin composition includes the above-mentioned resin component and if necessary, various additives. The extrusion method may vary depending on the type of the resin component and the like and cannot be uniformly determined; however, for example, a method of performing extrusion at a temperature higher than or equal to the melting temperature of the resin component using an extrusion die having an opening having a shape that is similar or approximately similar to the cross-sectional shape of the copper wire or the like, may be mentioned.

It is preferable that the extrusion coating layer is formed by extrusion molding; however, the method is not limited to this, and the extrusion coating layer may also be formed in the same manner as in the case of the baked coating layer described above, using a varnish including the above-mentioned thermoplastic resin, solvent, and the like and optionally including various additives.

From the viewpoint of productivity, it is preferable to form an extrusion coating layer by extrusion molding.

As described above, the winding wire of the present invention has a stranded wire obtained by twisting a plurality of element wires, each element wire being a copper wire having a small wire diameter such as 0.05 to 0.5 mm. In addition, the stranded wire includes at least one magnetic element wire. Furthermore, the winding wire of the present invention also has an extrusion coating layer having a particular thickness. As a result, the direct current resistance and losses caused by the skin effect can be reduced as will be described below. In addition, the penetration of an interlinkage magnetic flux of other element wires into the copper wire can be prevented, and losses caused by the proximity effect can also be reduced. Furthermore, a sufficient distance between adjacent winding wires can be secured while the reduction of losses is maintained. Accordingly, together with the effects of the limitation of the wire diameter and inclusion of a magnetic element wire, penetration of an interlinkage magnetic flux of other element wires into the copper wire can be further suppressed, and losses caused by the proximity effect can be further reduced.

<<Coil and Transformer>>

<Coil>

The coil of the present invention uses the winding wire of the present invention described above. Specifically, the coil is a product obtained by using an iron core formed from a ferromagnetic or ferrimagnetic material, or air as a core and winding the winding wire of the present invention around the core.

According to the present invention, in regard to the core such as an iron core, the size is selected as appropriate in accordance with the use application or the like. Furthermore, the method of winding the winding wire, the number of turns (two or more turns), the pitch, and the like are also selected as appropriate in accordance with the use application or the like. Particularly, since the winding wire of the present invention can effectively suppress an increase in the alternating current resistance caused by an increase in the frequency as described above, the number of element wires used can be reduced in order to provide a predetermined transformer function. Alternatively, since the operating frequency of the transformer can be increased, the size of the core can be decreased proportionally, or the number of turns can be reduced proportionally.

<Transformer>

Regarding the transformer of the present invention, the structure, size and the like of the transformer are not particularly limited as long as the transformer has the coil of the present invention. For example, the transformer includes a plurality of coils including a coil on the input side (primary coil) and a coil on the output side (secondary coil). The transformer can convert the voltage of an alternating current according to the ratio of the number of turns of the primary coil and the number of turns of the secondary coil.

The transformer of the present invention includes two or more coils, and preferably two coils, and the transformer includes the coil of the present invention as at least one those coils. More preferably, both of the two coils are formed from the coil of the present invention.

The transformer of the present invention may have a primary coil and a secondary coil respectively obtained by winding a winding wire around cores that are different from each other, or the transformer may be produced by winding the winding wire of the primary coil and the winding wire of the secondary coil respectively around the same core, either directly or using an insulating tape or the like.

<Use>

The coil and the transformer of the present invention are respectively preferably used for power supplies, and particularly for switching power supplies. A power supply refers to an apparatus that supplies a certain particular voltage and a certain particular current.

The coil and the transformer of the present invention are preferably used for switching power supplies, and particularly, the coil and the transformer are preferably used for an alternating current (AC)/direct current (DC) converter that transforms the voltage of the mains electricity, which is an alternating current, and commutates the mains electricity so as to convert the alternating current to a direct current having a voltage appropriate for electrical/electronic equipment.

In regard to conventional power supplies, the size can be made smaller by increasing the frequency; however, the value of the alternating current resistance of the winding wire, the losses of the switching element, or the like increase, and the amount of heat generation is increased. As a result, the temperature of various component parts increases, and the usable frequency is limited by a member that can most easily reach the heat-resistant temperature.

However, the winding wire of the present invention can effectively suppress the alternating current resistance of a high-frequency current during passage of electricity when the winding wire is produced into a coil, as described above. Therefore, in the coil or transformer that uses the winding wire of the present invention, losses are effectively suppressed. Furthermore, heat generation caused by the resistance of the coil is suppressed, and the temperature increase in the coil is lowered, which further contributes to size reduction of the coil or the like. Moreover, the frequency that is applicable to a transformer (switching power supply) can also be increased to a higher frequency. The frequency that is applicable to the transformer of the present invention is not particularly limited; however, for example, the frequency may be 100 kHz to 1 MHz.

The alternating current resistance is usually lowered when the number of element wires in the stranded wire is increased; however, the outer diameter of the winding wire increases. However, since the winding wire of the present invention can reduce the alternating current resistance as described above, the number of element wires in the stranded wire that is used to provide a predetermined transformer function can be reduced. Therefore, the increase in the outer diameter of the winding wire can be suppressed, and the winding wire also has excellent bending processability at the time of winding the winding wire around a core or the like. Furthermore, in order to secure insulation properties, for example, the use of an insulating tape or the like, which is used between coils and the core, can be omitted or avoided, and this also contributes to the size reduction as described above. Furthermore, cost increase can be suppressed.

Furthermore, the transformer of the present invention has the coil of the present invention. Therefore, in addition to the effect described above, the transformer exhibits higher electrical transmission efficiency. Also, since temperature increase is suppressed, the transformer provides an effect by which heat countermeasure component parts such as a cooling fan and a heat dissipation plate can be eliminated or reduced.

EXAMPLES

The present invention will be described in more detail based on examples given below, but the invention is not meant to be limited by these.

Example 1

In the present example, a winding wire 1E illustrated in FIG. 5 (provided that the extrusion coating layer has a two-layer structure) was produced as follows.

(Production of a Winding Wire)

—Production of Magnetic Baked Coated Element Wire—

First, seven magnetic baked coated element wires 11 were produced. That is, iron was electroplated on the surface of a copper wire (cross-sectional shape: circular shape) 11*a* having an element wire diameter of ϕ 0.12 mm, and thereby a magnetic layer 11*b* having the thickness of 2.0 μm was formed. Next, a polyurethane resin varnish (trade name: TPU F2-NC, manufactured by TOTOKU TORYO CO., LTD.) was applied on the surface of the magnetic layer 11*b* and baked, and the applying step and the baking step were repeated several times. Thus, a baked coating layer 11*c* having the thickness of 10 μm was formed.

—Production of a Stranded Wire—

In a state in which one magnetic baked coated element wire 11 produced as such was disposed as a center, and six magnetic baked coated element wires 11 were disposed around the center, these element wires 11 were twisted at a twisting pitch of 8 mm. Thus, a stranded wire 2E was produced.

—Formation of an Extrusion Coating Layer—

Next, a PET resin was extrusion molded to the thickness of 33 μm on the outer circumference of this stranded wire 2E. This extrusion molding was repeated two times, and thus, winding wire 1E (outer diameter: 0.564 mm) having the stranded wire 2E and an extrusion coating layer 3E having a two-layer structure composed of winding wire extrusion coating layers $\mathbf{3}E_1$ and $\mathbf{3}E_2$ and having the thickness of 66 μm was produced.

(Production of Coil)

The winding wire 1E thus obtained was wound 36 turns around a bobbin having an outer diameter of 15 mm, and thus a coil of Example 1 was produced. In this coil, the wound winding wires were all aligned to be in contact.

Example 2

A winding wire 1E (outer diameter: 0.630 mm) having a stranded wire 2E and an extrusion coating layer 3E having the thickness of 99 μm was produced in the same manner as in the production of the winding wire of Example 1, except that in regard to the formation of the extrusion coating layer of Example 1, extrusion molding as described above was repeated three times. This extrusion coating layer 3E has a three-layer structure composed of the winding wire extrusion coating layers $\mathbf{3}E_1$ to $\mathbf{3}E_3$.

Furthermore, a coil of Example 2 was produced in the same manner as in Example 1, by using the winding wire thus obtained.

Comparative Example 1

A stranded wire 2E that did not include an extrusion coating layer (thickness of the extrusion coating layer: 0 μm, outer diameter: 0.432 mm) was produced in the same manner as in the production of the winding wire of Example 1, except that in regard to the production of the winding wire of Example 1, the extrusion molding described above was not performed.

Furthermore, a coil of Comparative Example 1 was produced in the same manner as in Example 1, by using the winding wire thus obtained.

Comparative Example 2

A winding wire (outer diameter: 0.498 mm) having a stranded wire 2E and an extrusion coating layer (single-layer structure) having the thickness of 33 μm was produced in the same manner as in the production of the winding wire of Example 1, except that in regard to the formation of the extrusion coating layer of Example 1, extrusion molding as described above was carried out once.

Furthermore, a coil of Comparative Example 2 was produced in the same manner as in Example 1, by using the winding wire thus obtained.

Comparative Example 3

In the present Example, a winding wire 21 (FIG. 7) having a stranded wire 22 formed from seven baked coated element wires 12; and an extrusion coating layer 23 was produced as follows.

A winding wire (thickness of the extrusion coating layer 23: 66 μm, outer diameter: 0.552 mm) 21 was produced in the same manner as in the production of the winding wire of Example 1, except that in regard to the production of the magnetic baked coated element wire of Example 1, a baked coating layer 24 having the thickness of 10 μm was formed without providing the magnetic layer 11*b*.

Furthermore, a coil of Comparative Example 3 was produced in the same manner as in Example 1, by using the winding wire 21 thus obtained.

Comparative Examples 4~6

Figure 7:
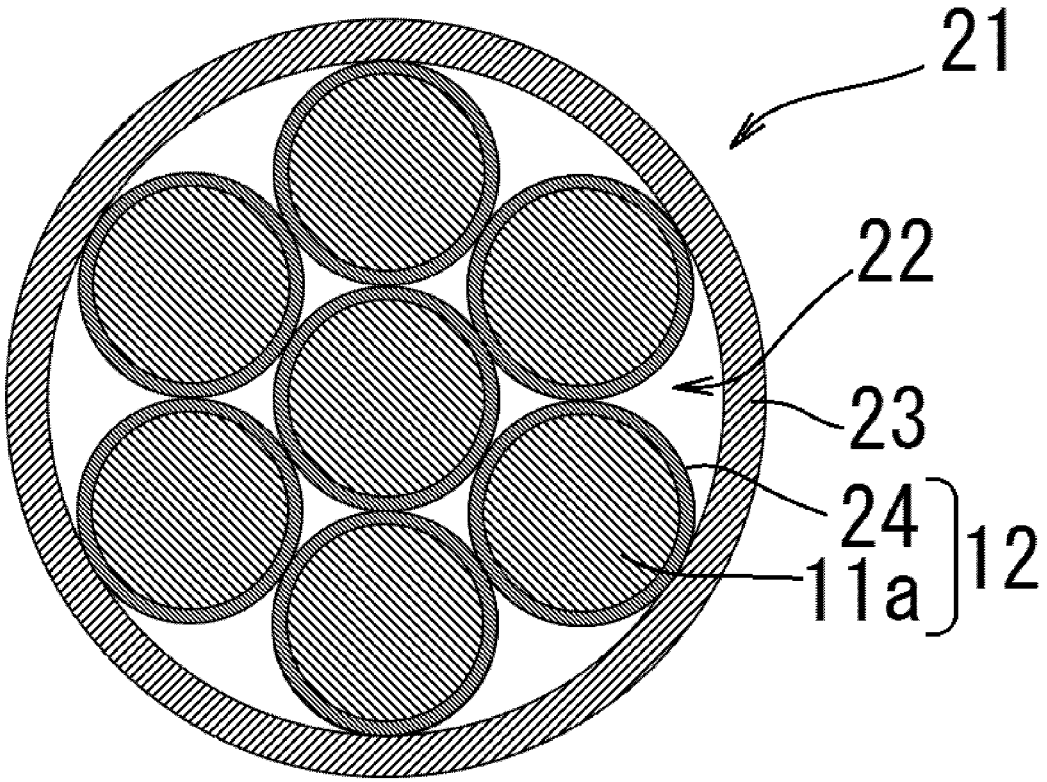
FIG. 7 is a schematic end view illustrating an example of a conventional winding wire.

Winding wires 21, as illustrated in FIG. 7, were produced in the same manner as in the production of the winding wire of Example 2 (thickness of the extrusion coating layer: 99 μm), Comparative Example 1, or Comparative Example 2, except that in regard to the production of the magnetic baked coated element wire of Example 1, a baked coating layer 24 having the thickness of 10 μm was formed without providing the magnetic layer 11*b*. The winding wires of Comparative Examples 4 to 6 thus obtained were such that the thicknesses of the extrusion coating layer 23 were 99 μm, 0 μm, and 33 μm, respectively, and the outer diameters were 0.618 mm, 0.420 mm, and 0.486 mm, respectively.

Furthermore, a coil of Comparative Examples 4~6 was produced in the same manner as in Example 1, by using the winding wire 21 thus obtained.

<Performance Evaluation of Coil>

Figure 8:
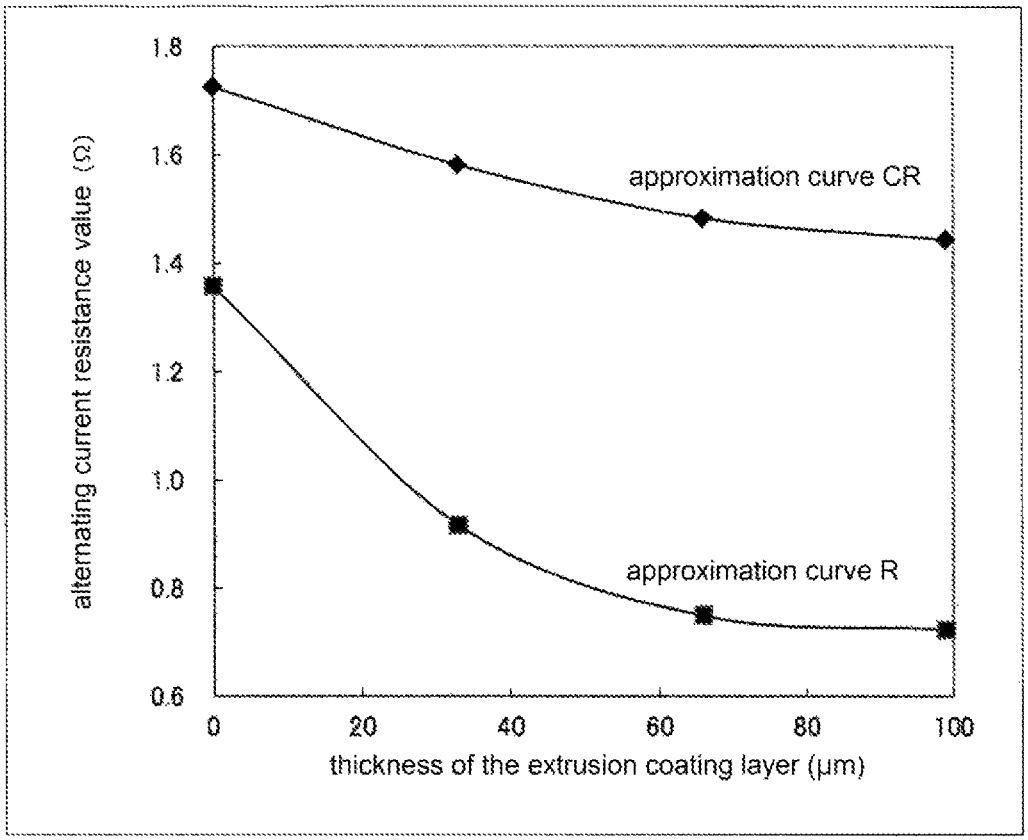
FIG. 8 is a graph showing the results of measuring the alternating current resistance values of various winding wires in the Examples.

Regarding the alternating current resistance value of each of the coils thus produced, the resistance value obtainable when an alternating current at a frequency of 1 MHz was passed through was measured using an LCR meter (trade name: E4980A, manufactured by Agilent Technologies). The results are presented in FIG. 8. FIG. 8 shows approximation curves R and CR for winding wires having a magnetic baked coated element wire 11 (Comparative Example 1, Examples 1 and 2, and Comparative Example 4) and winding wires that did not include a magnetic baked coated element wire 11 (Comparative Examples 3 to 6), respectively.

As shown in FIG. 8, when the winding wire 21 produced using a stranded wire 22 that did not include a magnetic baked coated element wire 11 (Comparative Examples 3 to 6) was produced into a coil, as the thickness of the extrusion coating layer 23 increased, the value of the alternating current resistance gradually decreased; however, the amount of decrease was small (approximation curve CR). In contrast, when the winding wire 1 produced using a stranded wire 2A that included a magnetic baked coated element wire 11 (Examples 1 and 2, and Comparative Examples 1 and 2) was produced into a coil, it was found that as the thickness of the extrusion coating layer increased, the value of the alternating current resistance significantly decreased (approximation curve R).

Specifically, in regard to the winding wire 21 and the winding wire 1, the percentage decrease for the value of the alternating current resistance of Comparative Example 5 or 1, which had the thickness of the extrusion coating layer of 0 μm, was 92% (Comparative Example 6), 86% (Comparative Example 3), 84% (Comparative Example 4), and 68% (Comparative Example 2). In contrast, in Example 1 having the thickness of the extrusion coating layer of 66 μm, the percentage decrease was 55%, and in Example 2 having the thickness of the extrusion coating layer of 99 μm, the alternating current resistance could be decreased to 53%.

Generally, in order to decrease the alternating current resistance, the extrusion coating layer is made as thin as possible, and the cross-sectional area of the copper wire is increased. That is, a countermeasure for increasing the space factor is considered effective. However, at a frequency of several hundred kHz to 1 MHz, the influence exerted by an increase in the alternating current resistance caused by the proximity effect is larger than the influence exerted by the direct current resistance. Therefore, it could be confirmed that it is effective to reduce an increase in the alternating current resistance caused by the proximity effect by increasing the distance between copper wires, rather than to decrease the direct current resistance by increasing the cross-sectional area of the copper wire.

Furthermore, as described above, in regard to a winding wire produced using the stranded wire 2E including a magnetic baked coated element wire 11, it was found that the value of the alternating current resistance reaches the bottom value particularly around the thickness of the extrusion coating layer 3E of 40 μm as the boundary (Examples 1 and 2, and Comparative Examples 1 and 2; approximation curve R). This is speculated to be because an appropriate distance between winding wires could be secured when the winding wire of the present invention having the configuration as described above was used in a coil. That is, the magnetic layer 11*b* can prevent penetration of a magnetic flux into the copper wire 11*a* existing in the vicinity, as the magnetic permeability is high, and the flow of the magnetic flux is concentrated. On the other hand, the magnetic flux flowing into the magnetic layer 11*b* is converted to heat energy and is consumed; however, a portion thereof may generate an eddy current in the copper wire 11*a* in the vicinity and increase the value of alternating current resistance. However, it is speculated that when an appropriate distance between copper wires is secured, the penetration of the magnetic flux and the generation of an eddy current can be prevented in a well-balanced manner. This is also the same between winding wires; however, in a coil, a superior effect is exhibited on the reduction of the alternating current resistance when the penetration of a magnetic flux and the generation of an eddy current between winding wires are prevented, rather than the penetration of a magnetic flux and the generation of an eddy current between copper wires are prevented. Therefore, it was found that the winding wire 1E of the present invention having a stranded wire 2E that includes a magnetic baked coated element wire 11 including a copper wire having a particular wire diameter and a magnetic layer; and an extrusion coating layer 3E having a particular thickness disposed on the outer circumference of the stranded wire 2E, has a low alternating current resistance at the time of passage of a high-frequency current, and that when the winding wire 1E is used in a coil or a transformer, the coil loss or the transformer loss can be effectively suppressed.

Having described our invention as related to the present embodiments, it is our intention that the invention not be limited by any of the details of the description, unless otherwise specified, but rather be construed broadly within its spirit and scope as set out in the accompanying claims.

This application claims priority on Patent Application No. 2016-086601 filed in Japan on Apr. 22, 2016, which is entirely herein incorporated by reference.

REFERENCE SIGNS LIST

1A~1F, 21 Winding wire
2A~2F, 22 Stranded wire
3A~3F, 23 Extrusion coating layer
3$E_1$~3$E_3$, 3$F_1$, 3$F_2$ Winding wire extrusion coating layer
3$F_3$ Element wire extrusion coating layer
11, 11A Magnetic baked coated element wire
11*a* Copper wire
11*b* Magnetic layer
11*c*, 24 Baked coating layer
12 Baked coated element wire
13 Magnetic extrusion coated element wire

The invention claimed is:

1. A winding wire comprising a stranded wire formed by twisting a plurality of element wires, each of the element wires having a copper wire having a wire diameter of 0.05 to 0.5 mm; and an extrusion coating layer coating the plurality of the element wires, wherein:

element wires arranged in the outermost row among the element wires included in the stranded wire have a magnetic layer on an outer circumference of the copper wire, the element wires having the magnetic layer on the outer circumference of the copper wire are arranged on an entire outer circumference of element wires that do not have the magnetic layer on the outer circumference of the copper wire, and the thickness of the extrusion coating layer is 40 to 100 μm.

2. The winding wire according to claim 1, comprising a baked coating layer on an outer circumference of the magnetic layer.

3. The winding wire according to claim 1, wherein the extrusion coating layer includes a winding wire extrusion coating layer disposed on an outer surface of the stranded wire.

4. The winding wire according to claim 1, wherein the extrusion coating layer is composed of three or more layers.

5. A coil, using the winding wire according to claim 1.

6. A transformer, comprising the coil according to claim 5.

7. The transformer according to claim 6, wherein the transformer is used for a high frequency switching power supply operating at a frequency of 100 kHz to 1 MHz.

* * * * *